US008114812B2

(12) United States Patent
Vandemark et al.

(10) Patent No.: US 8,114,812 B2
(45) Date of Patent: Feb. 14, 2012

(54) TWO-SIDED THERMAL PAPER

(75) Inventors: Michael J. Vandemark, Springboro, OH (US); Gerard J. Mullen, Miamisburg, OH (US); Mary Ann Wehr, Hamilton, OH (US)

(73) Assignee: NCR Corporation, Duluth, GA (US)

( * ) Notice: Subject to any disclaimer, the term of this patent is extended or adjusted under 35 U.S.C. 154(b) by 562 days.

(21) Appl. No.: 11/368,121

(22) Filed: Mar. 3, 2006

(65) Prior Publication Data

US 2007/0207926 A1 Sep. 6, 2007

(51) Int. Cl.
*B41M 5/035* (2006.01)
*B41M 5/34* (2006.01)
*B41M 5/382* (2006.01)

(52) U.S. Cl. ..... 503/226; 503/200; 503/227

(58) Field of Classification Search ..... None
See application file for complete search history.

(56) References Cited

U.S. PATENT DOCUMENTS

| | | | | |
|---|---|---|---|---|
| 3,947,854 | A | | 3/1976 | Hansen et al. |
| 4,167,392 | A | | 9/1979 | Defago |
| RE30,116 | E | | 10/1979 | Maalouf |
| 4,309,255 | A | | 1/1982 | Gendler et al. |
| 4,507,669 | A | | 3/1985 | Sakamoto et al. |
| 4,708,500 | A | | 11/1987 | Bangs et al. |
| 4,853,256 | A | | 8/1989 | Obringer et al. |
| 4,956,251 | A | | 9/1990 | Washizu et al. |
| 4,965,166 | A | | 10/1990 | Hosoi et al. |
| 4,987,118 | A | * | 1/1991 | Murata et al. ..... 503/200 |
| 5,055,373 | A | | 10/1991 | Saeki et al. |
| 5,101,222 | A | | 3/1992 | Hakkaku |
| 5,132,704 | A | | 7/1992 | Nakagawa |
| 5,196,297 | A | | 3/1993 | Dombrowski, Jr. et al. |
| 5,214,750 | A | | 5/1993 | Minowa et al. |
| 5,266,550 | A | | 11/1993 | Asajima et al. |
| 5,272,127 | A | * | 12/1993 | Mandoh et al. ..... 503/207 |
| 5,284,816 | A | | 2/1994 | Stephenson |
| 5,398,305 | A | | 3/1995 | Yawata et al. |
| 5,428,714 | A | | 6/1995 | Yawata et al. |
| 5,437,004 | A | | 7/1995 | Miyasaka et al. |
| 5,555,349 | A | | 9/1996 | Miyasaka et al. |
| 5,584,590 | A | | 12/1996 | Ito et al. |
| 5,585,321 | A | | 12/1996 | Breen et al. |
| 5,594,653 | A | | 1/1997 | Akiyama et al. |
| 5,629,259 | A | | 5/1997 | Akada et al. |
| 5,639,169 | A | | 6/1997 | Aruga |

(Continued)

FOREIGN PATENT DOCUMENTS

EP 0947340 10/1999

(Continued)

OTHER PUBLICATIONS

JP Abstract, vol. 007,No. 063 (M-200), Mar. 16, 1983 & JP 57-208298 A (Ricoh KK), Dec. 21, 1982.

(Continued)

*Primary Examiner* — Bruce H Hess
(74) *Attorney, Agent, or Firm* — Michael Chan

(57) ABSTRACT

Imaging elements for dual-sided direct thermal printing are described, generally comprising a substrate and a thermally sensitive coating on each side. Calendering is provided to produce a smoothness of 75 Bekk or greater on each side of the media product. A subcoat or base coat, e.g., of calcium carbonate or clay, may be provided on paper substrates to enhance smoothness of finish and the quality of thermal printing.

12 Claims, 1 Drawing Sheet

U.S. PATENT DOCUMENTS

| | | | | |
|---|---|---|---|---|
| 5,677,722 | A | 10/1997 | Park | |
| 5,692,110 | A | 11/1997 | Miyasaka et al. | |
| 5,707,925 | A | 1/1998 | Akada et al. | |
| 5,710,094 | A | 1/1998 | Minami et al. | |
| 5,741,592 | A | 4/1998 | Lewis et al. | |
| 5,755,521 | A | 5/1998 | Ito et al. | |
| 5,756,188 | A | 5/1998 | Reiter et al. | |
| 5,763,356 | A | 6/1998 | Ueno et al. | |
| 5,789,340 | A | 8/1998 | Brust et al. | |
| 5,792,725 | A | 8/1998 | Simpson et al. | |
| 5,794,530 | A | 8/1998 | Dobashi et al. | |
| 5,800,081 | A | 9/1998 | Teradaira et al. | |
| 5,815,191 | A | 9/1998 | Michielsen et al. | |
| 5,846,900 | A | 12/1998 | Reiter et al. | |
| 5,876,836 | A | 3/1999 | Imamura et al. | |
| 5,883,043 | A | 3/1999 | Halbrook, Jr. et al. | |
| 5,886,725 | A | 3/1999 | Miyadera et al. | |
| 5,918,910 | A | 7/1999 | Stillwagon et al. | |
| 5,964,541 | A | 10/1999 | Murison et al. | |
| 6,095,414 | A | 8/2000 | Long et al. | |
| 6,106,910 | A * | 8/2000 | Tan et al. | 428/29 |
| 6,130,185 | A | 10/2000 | Narita et al. | |
| 6,150,067 | A | 11/2000 | Koike et al. | |
| 6,165,937 | A * | 12/2000 | Puckett et al. | 503/201 |
| 6,210,777 | B1 | 4/2001 | Vermeulen et al. | |
| 6,267,052 | B1 | 7/2001 | Hill et al. | |
| 6,388,692 | B1 | 5/2002 | Iwata et al. | |
| 6,562,755 | B1 | 5/2003 | Halbrook, Jr. et al. | |
| 6,759,366 | B2 * | 7/2004 | Beckerdite et al. | 503/200 |
| 6,784,906 | B2 | 8/2004 | Long et al. | |
| 6,803,344 | B2 | 10/2004 | Halbrook, Jr. et al. | |
| 6,906,735 | B2 | 6/2005 | Bhatt et al. | |
| 7,192,904 | B2 * | 3/2007 | Iwasaki et al. | 503/216 |

FOREIGN PATENT DOCUMENTS

| | | |
|---|---|---|
| GB | 2 250 478 | 6/1992 |
| JP | 07 061141 A | 8/1993 |
| JP | 09 086041 A | 9/1995 |

OTHER PUBLICATIONS

JP Abstract, vol. 007, No. 081 (M-105), Apr. 5,1983 & JP 58-008668 A (Shinko Denki KK), Jan. 18, 1983.

JP Abstract, vol. 015, No. 194 (M-1114), May 20, 1991 & JP 03-051149 A (Fujitsu General Ltd.), Mar. 5, 1991.

JP Abstract, vol. 2000, No. 24, May 11, 2001 & JP 2001-199095 A (Alps Electric Co. Ltd.), Jul. 24, 2001.

JP Abstract, vol. 1998, No. 08, Jun. 30, 1998 & JP 10-076713 A (Sony Corp.), Mar. 24, 1998.

JP Abstract, vol. 010, No. 151 (M-483), May 31, 1986 & JP 61-003765 A (Konishiroku Shashin Kogyo KK), Jan. 9, 1986.

JP Abstract, vol. 016, No. 041 (M-1206), Jan. 31, 1992 & JP 03-246091 A (Canon Inc.), Nov. 1, 1991.

Boca Systems Micro Plus 2S 2 Sided Printer product brochure which came to the attention of Applicant at a Chicago tradeshow during the summer of 2002.

PCT/US2006/046745, International Preliminary Report on Patentability, with International Search Report, dated Sep. 9, 2008.

EP 06 84 7519.3, EPO Office Action, dated Oct. 23, 2009.

* cited by examiner

TWO-SIDED THERMAL PAPER

BACKGROUND

Duplex or dual-sided direct thermal printing of transaction documents or receipts is described in U.S. Pat. Nos. 6,784,906 and 6,759,366. The printers are configured to allow printing on both sides of sheet media moving along a feed path through the printer. In such printers a direct thermal print head is disposed on each side of the media feed path. A thermal print head faces an opposing platen across the feed path from the print head.

In direct thermal printing, a print head selectively applies heat to paper or other sheet media comprising a substrate with a thermally sensitive coating. The coating changes color when heat is transferred, by which "printing" is provided on the coated substrate. For dual-sided direct thermal printing, the sheet media substrate may be coated on both sides.

Duplex or dual-sided direct thermal printing has been described for providing variable information on both sides of a paper receipt, to save materials and to provide flexibility in providing information to customers. The printing could be driven electronically or by computer using a computer application program which directs dual-sided printing.

Given the general desirability of two-sided direct thermal printing for a variety of applications, qualified two-sided direct thermal imaging media or paper is needed.

SUMMARY

Imaging elements for dual-sided direct thermal printing are described, generally comprising a substrate and a thermally sensitive coating on each side. Calendering is provided to produce a smoothness of 75 Bekk or greater on each side of the media product. A subcoat or base coat, e.g., comprising calcium carbonate or clay, may be provided on paper substrates to enhance smoothness of finish and the quality of printing.

Alternative features, advantages and variations of the invention will be illustrated by example by the description to follow and the appended drawings and claims.

DETAILED DESCRIPTION

By way of example, various embodiments of the invention are described in the material to follow with reference to the included drawings. Variations may be adopted.

Background material applicable to direct thermal printing and related media production and common features generally is described in U.S. Pat. No. 6,803,344, the disclosure of which is hereby incorporated herein by reference.

Figure 1:
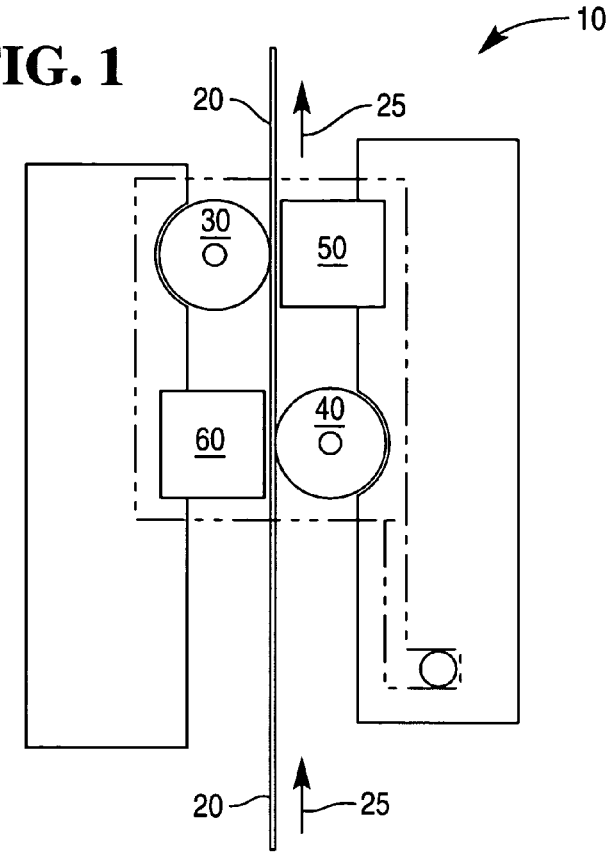
FIG. 1 shows a schematic of a dual-sided imaging direct thermal printer useable for dual-sided, single pass printing of media such as transaction receipts or tickets.

FIG. 1 shows a schematic of a dual-sided imaging direct thermal printer 10 useable for dual-sided, single pass printing of transaction receipts or tickets at time of issue. The printer 10 operates on print media 20 which is double-sided thermal paper, e.g., comprising a cellulose-based or polymer substrate sheet coated on each side with heat sensitive dyes as described in U.S. Pat. Nos. 6,784,906 and 6,759,366. Multi-color printing capability can be provided on both sides of the receipt by using two or more dyes with sensitivity to different temperatures on a side where multi-color printing is desired. Substrates and heat sensitive color changing coatings for direct thermal printing media are generally well known in the art. Dual-sided direct thermal printing can be facilitated by a media 20 which includes dyes sensitive to different temperatures on opposite sides of the media 20, or by use of thermally resistant substrates to inhibit thermal printing on one side of the media 20 from affecting the coloration on the opposite side of the media 20.

As shown in FIG. 1, the printer 10 has rotating platens 30 and 40 and opposing thermal print heads 50 and 60 on opposite sides of the receipt or ticket media 20. Dual-sided direct thermal printing of the media 20 occurs in a single pass at the time of the transaction or when a receipt or ticket is issued. The media 20 can be cut or severed to provide an individual receipt or ticket document, typically once printing is completed.

Figure 2A:
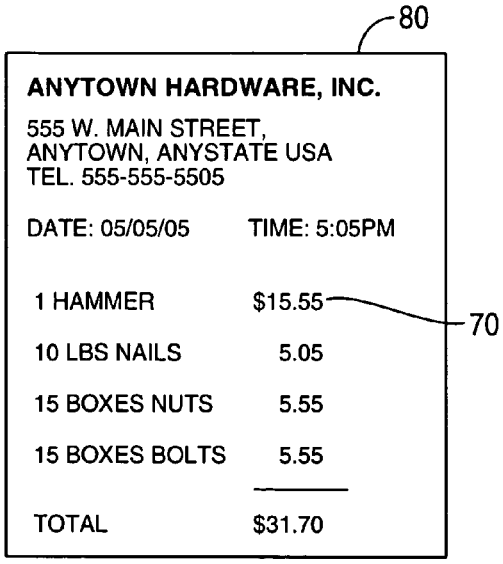
FIG. 2A shows a receipt with transaction detail printed on the front side.
Figure 2B:
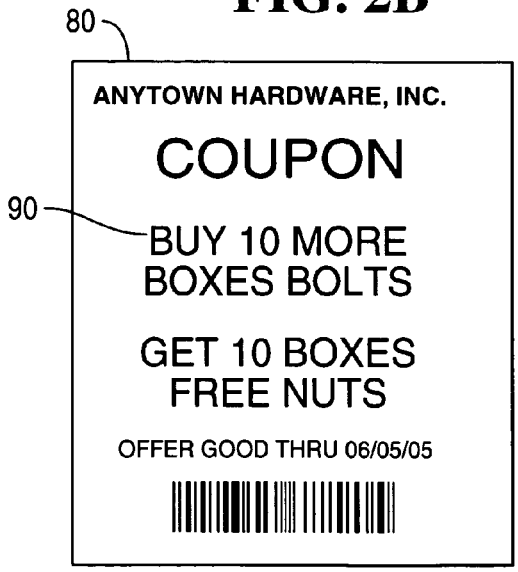
FIG. 2B shows a receipt with supplemental information printed on the reverse side, such as variable stored information determined at the time of the transaction.

FIG. 2A shows transaction detail 70 such as issuer identification, time, date, line item entries and a transaction total printed on the front side of a receipt 80. FIG. 2B shows custom information 90, e.g., based on recipient identity or transaction detail ascertained at transaction time, printed on the reverse side of the receipt 80. For example, custom information 90 could include further or duplicate transaction information, a coupon as shown, rebate or contest information, serialized cartoons, conditions of sale, document images, advertisements, security features, ticket information, or other information, e.g., custom information based on recipient identity or transaction data or detail.

Exemplary media 20 comprises an opaque substrate and a thermally sensitive coating on each side for general two-sided direct thermal printing applications. The substrate or base sheet can comprise those materials used in conventional direct thermal printing applications, including materials derived from synthetic or natural fibers such as cellulose (natural) fibers, e.g., opaque paper, and polyester (synthetic) fibers. Substrates may also include plastics, e.g., extruded plastic films using materials such as Kapton, polyethylene or polyester polymers. Calendering is provided to produce a smoothness of 75 Bekk or greater on each side of the media 20 to improve the thermal imaging. A subcoat or base coat, e.g., predominantly of calcium carbonate or clay, and binder material, e.g. a latex-based binder, may be provided on paper substrates to enhance smoothness of finish and the quality of direct thermal printing. Without a subcoat, a typical smoothness achieved by calendaring of base paper before applying thermally sensitive coatings would be in the range of 75-150 Bekk. With a subcoat and calendaring a finished smoothness of 250 Bekk or greater is typical. To give higher quality thermal imaging characteristics, e.g., for bar code printing, a minimum finished smoothness of 300 Bekk should be used. Where used, a subcoat weight of about 1-10 lbs/3300SFR (square foot ream) per side for one or both sides, preferably 2-5 lbs/3300SFR per side for one or both sides, is generally typical.

Calendering to provide smoothness of the sides of the media 20 can comprise, e.g., on-line or off-line soft or soft nip calendaring or supercalendering in one or more pass operations. Supercalendering, typically performed off-line from a paper production line, may be performed using a stack of alternating chilled cast iron and fiber-covered rolls. The fiber-covered rolls may for example be covered with highly compressed paper for processing uncoated papers, or with highly compressed cotton for processing papers with coatings. In a soft calendar, a composite-covered crown roll can run against a heated metal roll, e.g., in an in-line process, to produce a desired sheet surface finish and gloss. To calendar both sides of the media 20 in one pass, two or more roll stacks may be used.

Calendering of both sides of the media 20 for two-sided direct thermal printing has the benefit of providing the desired degree of smoothness to achieve a print quality required for a given application. The smoother the media 20 the less the print head wear will be, and concomitant abrasion of the media 20. A calendered subcoated surface of the media 20 also minimizes substrate interaction with thermally sensitive coating components.

The thermally sensitive coatings are preferably of the dye-developing type particularly when used with opaque paper substrates for the media 20, e.g., for two-sided direct thermal printing applications. Such coatings would typically comprise a developer, an optional sensitizer and color former or dye, e.g., leuco-dye, and undergo a color change upon transfer of heat. Different thermally sensitive coatings, e.g., of the dye-developing type or the dye-sublimation type, can be used with, e.g., plastic substrate materials. The dye-developing type thermally sensitive coating, e.g., overlying the subcoat where used, would generally have a weight of about 1-8 lbs/3300SFR, or preferably about 1-3 lbs/3300 SFR. Without a subcoat, the weight of a thermally sensitive layer will typically be greater.

A subcoat can be used on one side or both sides and the degree of calendering or finished smoothness can be the same or different on each side of the media 20, according to considerations of cost and the requirements of particular applications involved. For example, a higher quality of printing may be required for one side such as where printing of a bar code may be required. Such an application would normally require use of a subcoat and calendaring to a finished smoothness 300 Bekk or greater on the bar code print side of the media 20. The same finish or a less expensive finish might be used for the other side of the media 20. Similarly the character, chemical composition, thermal sensitivity and cost of the thermally sensitive coating could be the same or different on each of the two sides, e.g., a sensitizer may be used on one or both sides of the media 20 depending upon application. Different chemistries on the two sides of the media 20 can be employed to provide different environmental compatibilities or properties or other desired product characteristics.

The subcoat where used could be the same on each side or have a different composition or weight on each side of the media 20, again depending upon cost and application considerations. For example, if there is to be any ink jet printing as well as direct thermal printing on one side a calcium carbonate subcoat may be preferred.

The thermally sensitive coatings on each side of the media 20 can provide single color printing on each side of the media 20, where the print colors are the same or different on each side of the media 20. Alternatively, multiple color direct thermal printing may be implemented on one side or both sides, using multiple thermally sensitive coatings or multiple thermally sensitive layers within a coating, e.g., as taught in U.S. Pat. No. 6,906,735, or using multiple dyes within a coating layer, where the available print color choices are the same or different on each side of the media 20.

In some applications it may be desirable to provide the thermally sensitive coating on one or both sides of the media 20 in the form of a spot, strip or pattern coating or to provide for a spot, strip or pattern of special or higher cost finish on one or both sides. For example, to provide for printing of a bar code at a particular location on the media 20 the requisite smoothness of finish and thermally sensitive coating could be limited to that location. Repetitive sense marks could be applied to one or both sides of the media 20 to allow the bar code printing location to be identified during the bar code printing process. For some applications the sense marks could have different repeat lengths on opposite sides of the media 20, e.g., to allow for different intended print sizes.

For image protection and environmental durability, a top coat can be applied over the thermally sensitive coating on one or both sides of the media 20. Where used, the topcoat could comprise a spot, strip or pattern coating, e.g., for the added protection of a bar code. Repetitive sense marks could be applied to the media 20 to help identify the particular topcoat spot, strip or pattern locations.

To assist web severance or folding generally or in forms applications, repeating lines of perforation may be added to the media 20 in areas where separation or folding will be desired, e.g., to provide fan-folded multi-page documents printed on both sides.

The media 20 may be provided with one or more areas pre-printed by ink, thermal printing or other non-thermal printing on at least one side of the media 20, e.g., for security features, pre-printing of standard terms or advertising, depending on application requirements. The pre-printing could also provide a colored background area affecting the color of a final image. For example, yellow ink over a red image thermal paper could be used to provide an orange final image color.

For some applications the media 20 may be in the form of a two-ply web or comprise a two-ply substrate, e.g., for simultaneous printing of customer and merchant receipts and separable into the two separate receipt portions at a point of sale.

Generally the media 20 can preferably be expected to have a thickness in the range of 1.8 to 70 mils, a weight in the range of 11 to 115 lbs/1300SFR and an opacity in excess of 80%, depending upon the application or end-use requirements.

The foregoing description above presents a number of specific embodiments or examples of a broader invention. The invention is also carried out in a wide variety of other alternative ways which have not been described here. Many other embodiments or variations of the invention may also be carried out within the scope of the following claims.

What is claimed is:

1. An imaging element for dual-sided direct thermal printing, the imaging element comprising:

a substrate layer having a first side and a second side;

a thermally sensitive coating layer disposed on each of the first and second sides of the substrate layer;

a first subcoating layer comprising a first chemical composition disposed on the first side of the substrate layer and calendered to provide a first surface having a first degree of smoothness; and a second subcoating layer comprising a second chemical composition disposed on the second side of the substrate layer and calendered to provide a second surface having a second degree of smoothness, wherein (i) the second chemical composition of the second subcoating layer is different from the first chemical composition of the first subcoating layer, and (ii) the second degree of smoothness of the second surface is different from the first degree of smoothness of the first surface.

2. The imaging element of claim 1, wherein (i) the first degree of smoothness of the first surface is less than 300 Bekk, and (ii) the second degree of smoothness of the second surface is greater than 300 Bekk.

3. An imaging element for dual-sided direct thermal printing, the imaging element comprising:

a substrate layer having a first side and a second side;

a thermally sensitive coating layer disposed on each of the first and second sides of the substrate layer;

a first subcoating layer comprising a first subcoat weight disposed on the first side of the substrate layer and calendered to provide a first surface having a first degree of smoothness; and a second subcoating layer comprising a second subcoat weight disposed on the second side of the substrate layer and calendered to provide a second surface having a second degree of smoothness, wherein (i) the second subcoat weight of the second subcoating layer is different from the first subcoat weight of the first subcoating layer, and (ii) the second degree of smoothness of the second surface is different from the first degree of smoothness of the first surface.

4. The imaging element of claim 3, wherein the second subcoat weight of the second subcoating layer is about 2-5 lbs/3300SFR.

5. The imaging element of claim 4, wherein (i) the first degree of smoothness of the first surface is less than 300 Bekk, and (ii) the second degree of smoothness of the second surface is greater than 300 Bekk.

6. An imaging element for dual-sided direct thermal printing, the imaging element comprising:

a substrate layer comprising a first chemical composition and having a first side and a second side, wherein the first side of the substrate layer is calendered to provide a first surface having a first degree of smoothness;

a thermally sensitive coating layer disposed on each of the first and second sides of the substrate layer; and a subcoating layer comprising a second chemical composition and disposed on only the second side of the substrate layer and calendered to provide a second surface having a second degree of smoothness, wherein (i) the second chemical composition of the subcoating layer is different from the first chemical composition of the substrate layer, and (ii) the second degree of smoothness of the second surface is different from the first degree of smoothness of the first surface.

7. The imaging element of claim 6, wherein (i) the first chemical composition of the substrate layer comprises paper, and (ii) the second chemical composition of the subcoating layer comprises other than paper.

8. The imaging element of claim 7, wherein (i) the first degree of smoothness of the first surface is less than 300 Bekk, and (ii) the second degree of smoothness of the second surface is greater than 300 Bekk.

9. An imaging element for dual-sided direct thermal printing, the imaging element comprising:

a substrate layer comprising a substrate weight and having a first side and a second side, wherein the first side of the substrate layer is calendered to provide a first surface having a first degree of smoothness;

a thermally sensitive coating layer disposed on each of the first and second sides of the substrate layer; and a subcoating layer comprising a subcoat weight and disposed on only the second side of the substrate layer and calendered to provide a second surface having a second degree of smoothness, wherein (i) the subcoat weight of the subcoating layer is different from the substrate weight of the substrate layer, and (ii) the second degree of smoothness of the second surface is different from the first degree of smoothness of the first surface.

10. The imaging element of claim 9, wherein the subcoat weight of the subcoating layer is about 1-10 lbs/3300SFR.

11. The imaging element of claim 10, wherein the subcoat weight of the subcoating layer is about 2-5 lbs/3300SFR.

12. The imaging element of claim 11, wherein (i) the first degree of smoothness of the first surface is less than 300 Bekk, and (ii) the second degree of smoothness of the second surface is greater than 300 Bekk.

* * * * *